US009951546B1

(12) United States Patent
Maniaci

(10) Patent No.: US 9,951,546 B1
(45) Date of Patent: Apr. 24, 2018

(54) REDUNDANT BOLTWORK LOCK

(71) Applicant: American Security Products Co., Fontana, CA (US)

(72) Inventor: Anthony C. Maniaci, Temecula, CA (US)

(73) Assignee: AMERICAN SECURITY PRODUCTS CO., Fontana, CA (US)

( * ) Notice: Subject to any disclaimer, the term of this patent is extended or adjusted under 35 U.S.C. 154(b) by 0 days.

(21) Appl. No.: 15/720,091

(22) Filed: Sep. 29, 2017

Related U.S. Application Data

(60) Provisional application No. 62/446,776, filed on Jan. 16, 2017.

(51) Int. Cl.

| | |
|---|---|
| ***E05G 1/04*** | (2006.01) |
| ***E05B 65/00*** | (2006.01) |
| ***E05C 1/06*** | (2006.01) |
| ***E05B 1/00*** | (2006.01) |
| ***E05B 17/20*** | (2006.01) |
| ***E05B 47/06*** | (2006.01) |
| ***E05B 59/00*** | (2006.01) |

(52) U.S. Cl.
CPC ..... *E05B 65/0075* (2013.01); *E05B 1/00* (2013.01); *E05B 17/2007* (2013.01); *E05B 17/2038* (2013.01); *E05B 17/2069* (2013.01); *E05B 47/0603* (2013.01); *E05B 59/00* (2013.01); *E05C 1/06* (2013.01); *E05G 1/04* (2013.01)

(58) Field of Classification Search
CPC .. E05G 1/00; E05G 1/02; E05G 1/026; E05G 1/04; E05B 17/2007; E05B 17/203; E05B 17/2038; E05B 17/2069; E05B 47/06; E05B 47/0603; E05B 65/0075
See application file for complete search history.

(56) References Cited

U.S. PATENT DOCUMENTS

| | | | | |
|---|---|---|---|---|
| 2,732,815 | A * | 1/1956 | Paca et al. | E05G 1/04 109/59 R |
| 2,869,485 | A * | 1/1959 | Deaton | E05D 3/022 16/245 |
| 3,249,074 | A * | 5/1966 | Deaton | E05G 1/026 109/76 |
| 3,329,106 | A * | 7/1967 | Lingal | E05G 1/026 109/75 |
| 4,470,277 | A * | 9/1984 | Uyeda | E05B 65/0075 292/34 |
| 5,231,935 | A * | 8/1993 | Oder | E05B 65/0082 109/59 R |

(Continued)

*Primary Examiner* — Christopher J Boswell
(74) *Attorney, Agent, or Firm* — SoCal IP Law Group LLP; Guy L. Cumberbatch; Steven C. Sereboff

(57) ABSTRACT

A safe locking system that provides a means to operate one of two (or more) safe locks of any type to facilitate safe opening of a door. The safe door can be opened by operating either of two locks, regardless of the type or style; e.g., e-locks and mechanical locks. A sliding bar assembly is mounted to the rear face of the safe door for displacing the boltwork into and out of the door frame. Extension of the lock bolts of both locks prevents movement of a main locking bar and attached boltwork, which prevents a user from opening the door. Retraction of either of the lock bolts permits sliding movement of the main locking bar, such that a user can unlock the door from the frame.

19 Claims, 7 Drawing Sheets

(56) References Cited

U.S. PATENT DOCUMENTS

| | | | | |
|---|---|---|---|---|
| 5,341,752 | A * | 8/1994 | Hambleton | E05B 63/20 109/59 R |
| 5,603,234 | A * | 2/1997 | Lozier | E05B 63/143 292/36 |
| 6,679,087 | B2 * | 1/2004 | Suggs | E05B 65/0075 109/59 R |
| 8,479,543 | B2 * | 7/2013 | Yang | E05B 5/00 109/59 R |
| 9,097,057 | B2 * | 8/2015 | Pendleton | E05B 17/2038 |
| 9,238,929 | B2 * | 1/2016 | Cho | E05B 65/0082 |
| 2012/0060726 | A1 * | 3/2012 | Yao | E05B 27/0007 109/63.5 |

* cited by examiner

REDUNDANT BOLTWORK LOCK

RELATED APPLICATION INFORMATION

This patent claims priority under 35 U.S.C. § 119 from Provisional Patent Application No. 62/446,776, filed Jan. 16, 2017, titled "REDUNDANT BOLT LOCKWORK", which is expressly incorporated by reference in its entirety.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

Field

This disclosure relates to a safe locking system (boltwork) that provides a means to operate one of two (or more) safe locks of any type to facilitate safe opening.

Description of the Related Art

In the security safe industry, a safe lock is the heart of a safe locking system. The safe lock itself is a blocking device that prevents the movement of a larger, much more robust system of moveable bolts and/or bars that engage the jambs in the safe body, preventing door opening. This larger moving system that keeps the door engaged with the body of the safe is commonly referred to as the boltwork.

To open a safe, one must first unlock the safe lock, then actuate the boltwork to an unlocked position before the door can be opened.

Safe locks come in a vast array of types and designs. Mechanical combination locks, using an external circular dial and internal rotary wheel lock, have been the standard for safe locks for centuries. More recent innovations have come about as electronic technologies matured, where electromechanical locks have been developed using digital circuitry coupled to actuators like solenoids and motors.

E-locks are desirable because they provide many "features" that provide a higher degree of security, much quicker access, they can be operated in the dark with lighted entry keys, they can record operational data, rapid authentication code changes without the need to hire a skilled technician, integration with external digital systems, silent signal alarm triggering, and many other desirable capabilities.

With the advent of electronic locks (e-locks) comes issues of reliability that are not found with mechanical safe locks. Electronics are somewhat less reliable than mechanical locks, whereas when they do fail, there is seldom an opportunity to resolve the failure without destructive penetration of the safe. In contrast, mechanical locks tend to fail more gradually, and generally allow a skilled technician an opportunity to open the lock without destructive measures.

E-locks also rely on a power source, which is prone to decay. In some use cases, the reliability of rapid access to the safe contents is a serious concern, as in weapons storage where the user requires quick acquisition of their defensive tools. The failure of the power source, be that battery or domestic power sources, is a worry for the consumer. In contrast, the mechanical lock does not suffer from this issue.

In addition, there is a general concern by a segment of the population that fear the potential failure of the e-lock from the instruments of war, such as an Electro-magnetic pulse (EMP) attack. In this case, the access to self-defense weapons could be vital to survival, and the destructive forces of the EMP event could render the e-lock useless.

So, there is a strong market preference to provide the reliability of the mechanical lock, and enjoy the convenience and rich feature capabilities of e-locks.

In recent years, lock manufacturers have come to resolve this dilemma with specialized safe locks that provide both digital functionality, coupled with a mechanical combination backup mechanism.

These types of locks suffer from some disadvantages. The "redundant locks" are much more complex, as hence very expensive. They have proven to be less reliable, due to the complex union of the mechanical and digital lock mechanism.

The redundant locks also tend to be much larger, such that they don't fit within the confines of a conventional safe lock envelope. This results in the undesirable requirement to modify the safe design to accommodate these dual-function redundant locks.

SUMMARY OF THE INVENTION

A disclosed safe locking system provides a means to operate one of two (or more) safe locks of any type to facilitate safe opening of a door. The safe door can be opened by operating either of two locks, regardless of the type or style; e.g., e-locks and mechanical locks. A sliding bar assembly is mounted to the rear face of the safe door for displacing the boltwork into and out of the door frame. Extension of the lock bolts of both locks prevents movement of a main locking bar and attached boltwork, which prevents a user from opening the door. Retraction of either of the lock bolts permits sliding movement of the main locking bar, such that a user can unlock the door from the frame.

DETAILED DESCRIPTION

It is desirable to provide means to use any mix of lock types and brands, such that the consumer has a choice of select any pairing of locks they desire based on reliability, cosmetic appeal, features and cost. A solution is disclosed herein where all of the consumer's needs are met. The safe can be opened by operating either of two locks, regardless of the type or style. The unique solution is in the boltwork mechanism, not in the locks themselves. The redundant boltwork lock mechanism is very compact in design, facilitating conventional safe locking system integration without considerable changes in the boltwork system.

Figure 1:
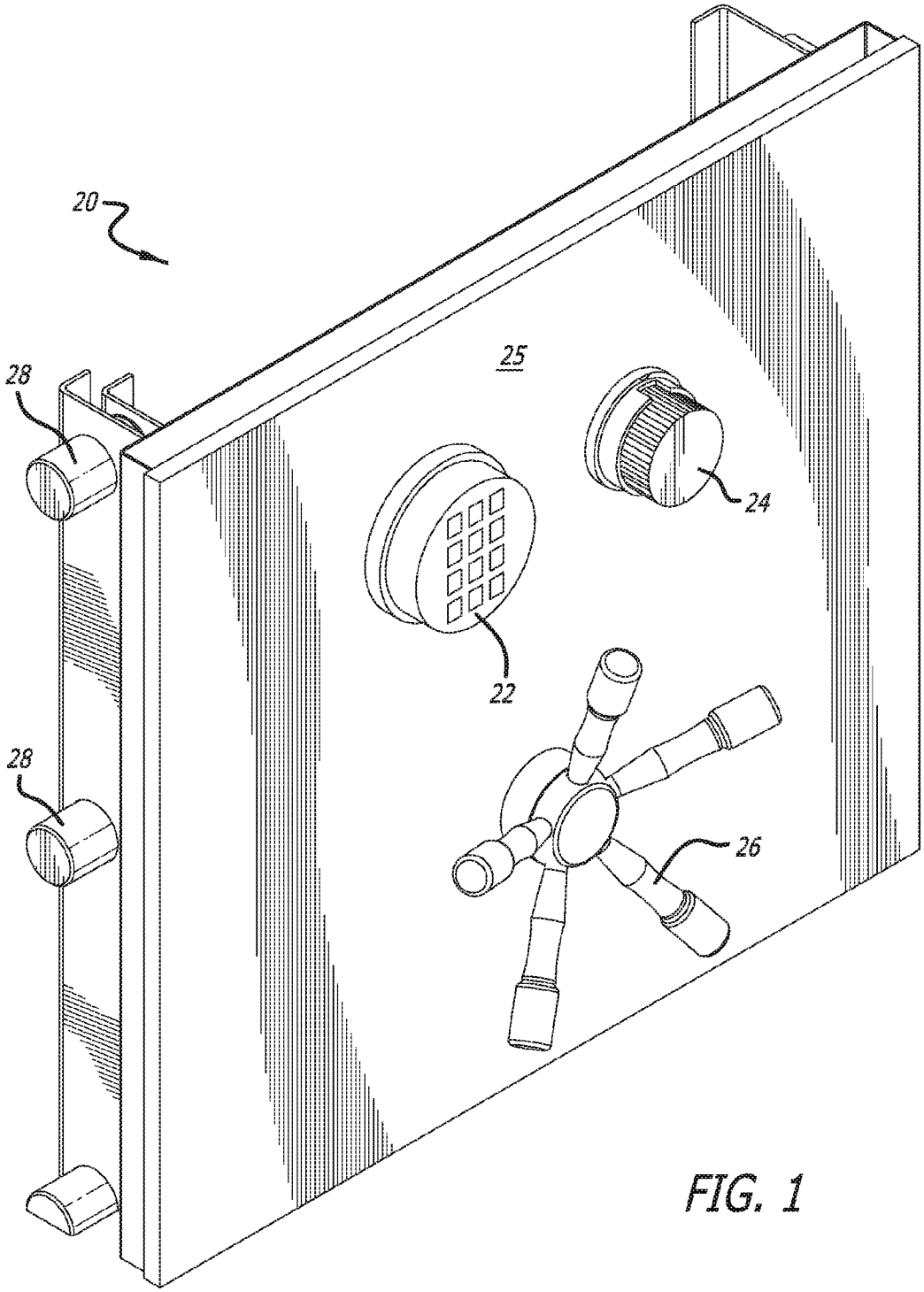
FIG. 1 is a perspective view of an exterior of a safe door having the combination mechanical and e-lock system.

FIG. 1 is a perspective view of an exterior of a safe door 20 having a hinge side on the right (as shown) or left looking from the front, and a locking side opposite thereto. The safe door 20 has an e-lock 22 and a mechanical lock 24 combination, which is the basic dual-lock layout. The e-lock 22 (left) is complemented by a mechanical dial combination lock 24 (combo-lock), both mounted to project outward from the main door panel 25. Although this arrangement is most common, there are endless potential placement and orientations of this mechanism. Likewise, although the e-lock 22 is shown as a touchpad with buttons, other types of electronic locks may be used, and the dial combination lock 24 may be replaced with a simple keylock or other type of mechanical lock. Unlocking either lock 22, 24 enables a user to then grasp and rotate the 5-spoke handle 26 in order to retract the locking bolts 28 from complementary holes provided in a doorframe (not shown).

Figure 2:
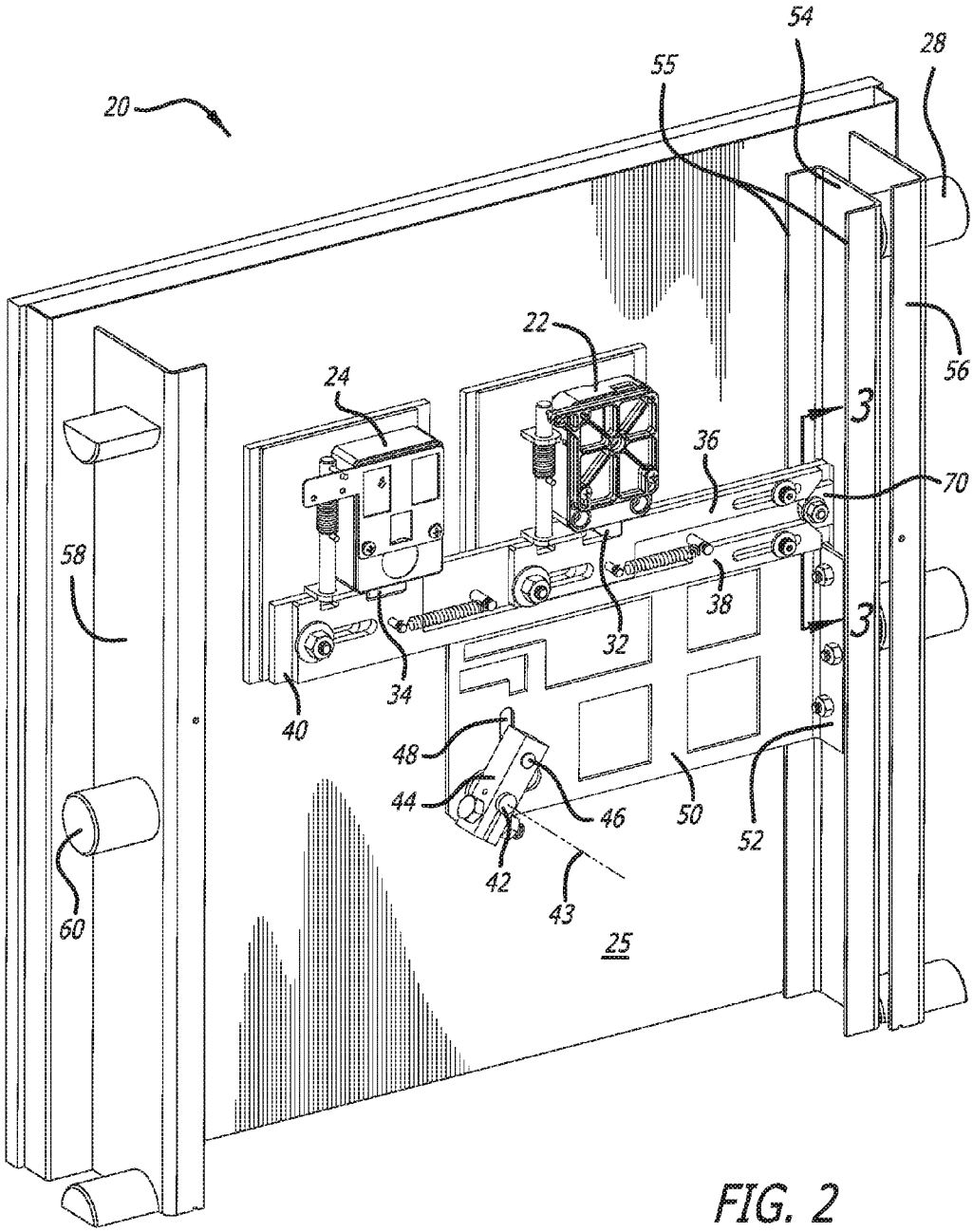
FIG. 2 is a perspective view of an interior of the exemplary safe door having the combination mechanical and e-lock system.

FIG. 2 is a perspective view of an interior of the exemplary safe door 20 having the combination e-lock 22 and mechanical lock 24 systems. Typically, the locks 22, 24 are mounted to reinforced plates (not numbered) on the inside of the door panel 25 to help prevent tampering. Each lock 22, 24 has a respective latch bolt 32, 34 that projects downward into engagement with cutouts (not numbered) in one of two lock slides 36, 38. The lock slides 36, 38 are secured over a main locking bar 40 and can slide horizontally with respect thereto. Cooperation between these parts will be described below.

The 5-spoke handle 26 seen in FIG. 1 has a handle shaft 42 that is journaled about a horizontal axis 43 and projects through the door panel 25. A drive lever 44 clamps over the handle shaft 42 and rotates therewith. The drive lever 44 carries a cam pin 46 on the end opposite the axis 43 that accordingly rotates with the handle shaft 42 and extends into a vertical cam slot 48 formed in a drive plate 50. As will be described below, rotation of the handle shaft 42 causes horizontal translation of the drive plate 50 via the drive lever 44 and cam pin/slot 46, 48 engagement.

The drive plate 50 lies flush against the inner face of the door panel 25 except for a vertical flange 52 that is bent 90°. Three fasteners (not numbered) secure the vertical flange 52 to a vertically-oriented and movable carriage bar 54, having bent flanges 55, that carries the three locking bolts 28. Thus, horizontal movement of the drive plate 50 causes horizontal movement of the carriage bar 54 and three locking bolts 28 which can be extended into a locked position or retracted into an open position. The combination of the carriage bar 54 and locking bolts 28 make up the so-called moving "boltwork."

The locking bolts 28 extend through apertures in a fixed bolt guide 56 that is secured to the inner face of the door panel 25, such as by welding. A second fixed bolt guide 58 having one whole and two half fixed locking bolts 60 is also secured to the inner face of the door panel 25 on the side having hinges (not shown). Because of the projection of the fixed locking bolts 60 and the complementary configuration of the door frame (not shown) on the hinge side, the safe door 20 is securely held to the door frame on both sides when closed and the locking bolts 28 extended.

The redundant boltwork lock system works in the same basic way of a conventional boltwork, where a lock is actuated to remove the blocking of the larger bolt-moving mechanism that holds the door shut. However, in the redundant boltwork lock system, either or both locks 22, 24 can be articulated to allow the boltwork to be retracted. The key element in the mechanism is a rotating cam 70 seen on the right side in FIG. 2 that toggles to allow one lock slide 36, 38 or the other to move laterally.

Figure 3:
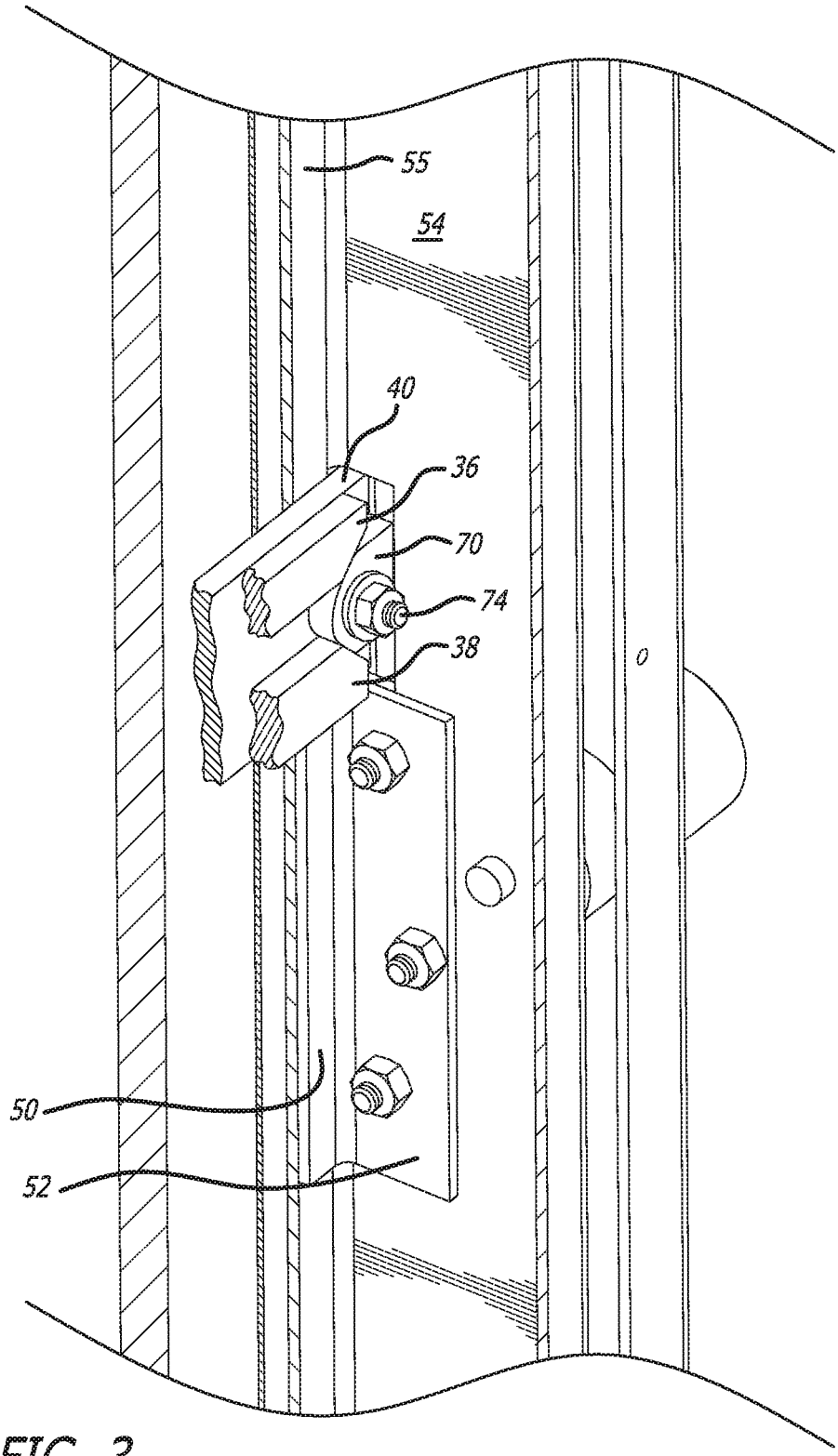
FIG. 3 is an enlarged view taken along line 3-3 in FIG. 2.

FIG. 3 is an enlarged view taken along line 3-3 in FIG. 2 which shows the connections between the rotating cam 70 and the other components. Specifically, and also with reference to the exploded view of FIG. 4, the cam 70 rotates via a bushing 72 on a mounting shaft 74 and is secured via a nut 76 to a bent flange 55 of the carriage bar 54. The mounting shaft 74 also passed through an aperture 78 formed in the main locking bar 40. As will be explained below, because of this secure connection between the cam 70 and the carriage bar 54, the locking bolts 28 cannot be retracted if the cam is fixed in place, and the cam cannot move without movement of either one of the lock slides 36, 38.

Figure 4:
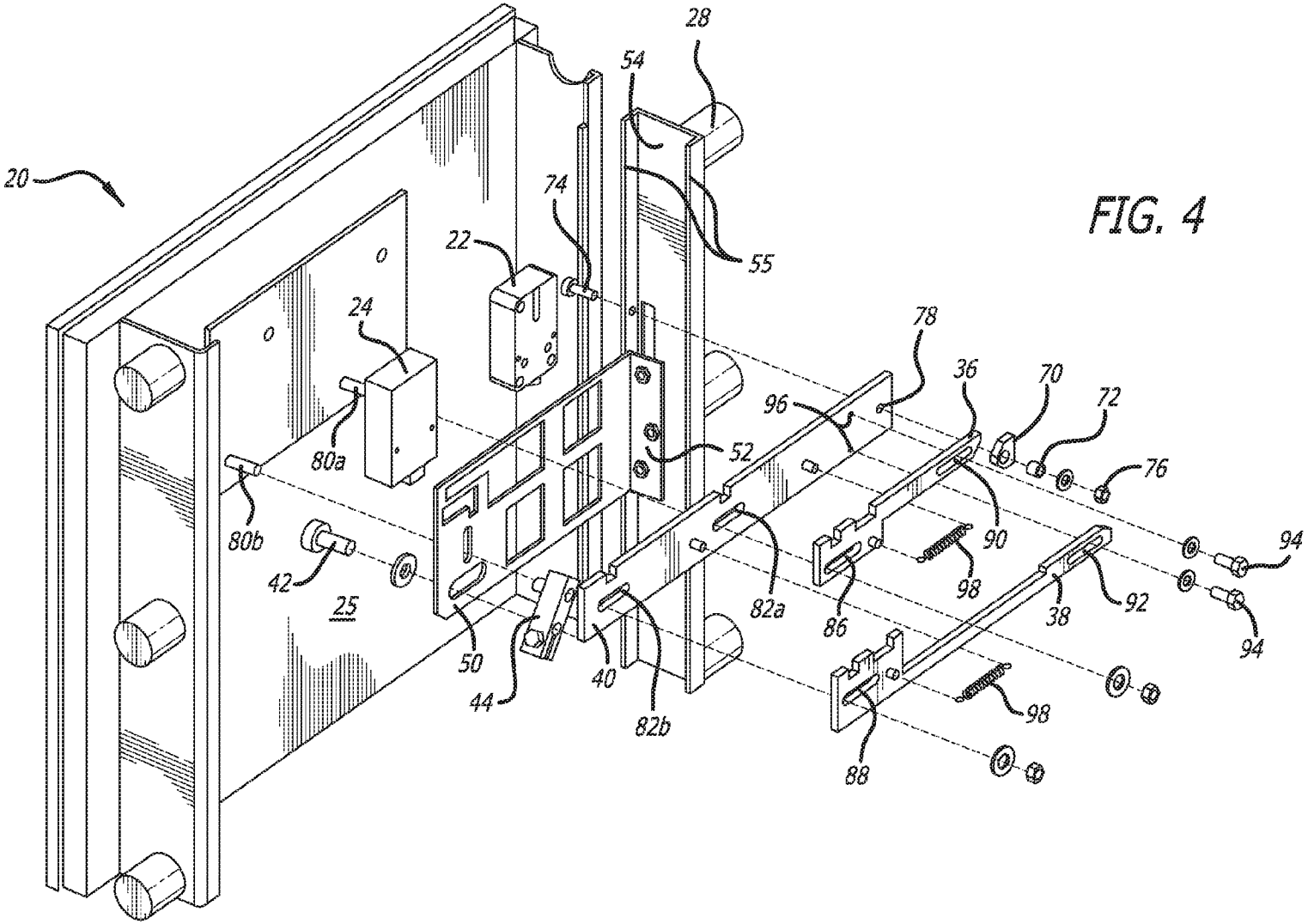
FIG. 4 is a perspective exploded view of the interior components of the safe door.

Prior to describing the boltwork movement, FIG. 4 also illustrates how the two lock slides 36, 38 and main locking bar 40 are assembled. First of all, a pair of fixed studs 80*a*, 80*b* project rearward from the rear face of the door panel 25. Each stud 80*a*, 80*b* passes through a respective horizontal slot 82*a*, 82*b* in the main locking bar 40 and through a horizontal slot 86, 88 at the left end of each of the lock slides 36, 38. Fasteners (not numbered) secure the lock slides 36, 38 and main locking bar 40 to the studs 80*a*, 80*b* while allowing sliding movement therebetween.

A second pair of horizontal slots 90, 92 are provided on the right end of each of the lock slides 36, 38. Shoulder bolts 94 extend through the slots 90, 92 and are secured respectively to two threaded apertures 96 to the right end of the main locking bar 40. In this manner, the main locking bar 40 may slide horizontally relative to the fixed studs 80*a*, 80*b*, and both of the lock slides 36, 38 may slide relative to the main locking bar 40. Furthermore, both of the lock slides 36, 38 are biased to the right on the main locking bar 40 by springs 98 attached between small studs on each lock slide and studs on the locking bar 40 (studs not numbered for clarity).

It should also be noted that the upper lock slide 36 is shorter than the lower lock slide 38 and the two lock slides have mating shapes. The lower lock slide 38 has an enlarged left end in which is formed the slot 88, and an elongated portion that extends to its right end and the slot 92. The upper lock slide 36 also has an enlarged left end in which is formed the slot 86, and an elongated portion that extends to its right end and the slot 90. As seen best in FIG. 5A, the upper lock slide 36 slides horizontally in a space created above the elongated right end of the lower lock slide 38, and has a vertical dimension such that the combined lock slides have an outer boundary that closely matches the dimensions of the main locking bar 40.

Figure 5A:
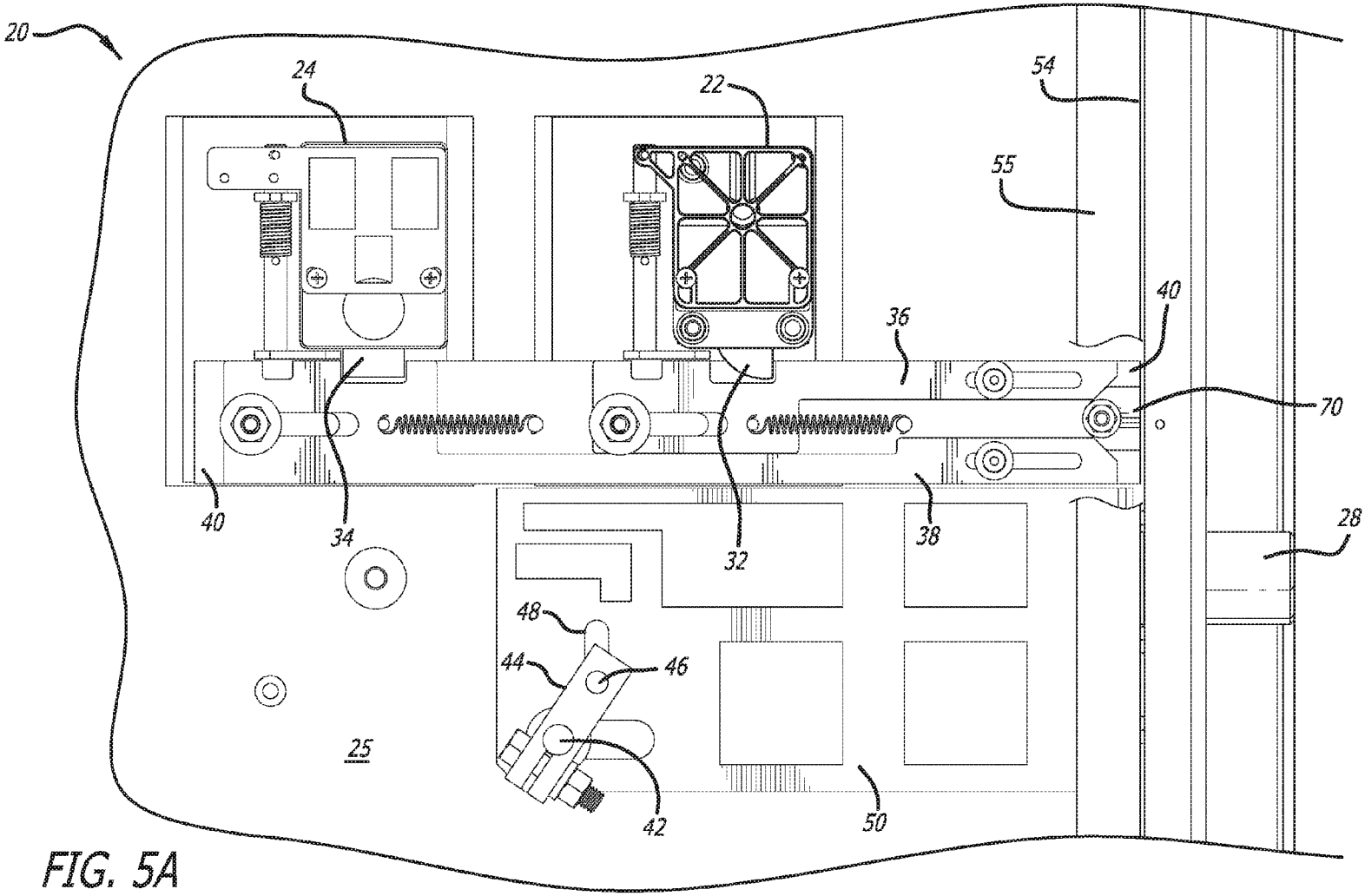
FIGS. 5A-5C are perspective views of the interior locking/boltwork mechanism of the exemplary safe door showing the three main stages of operation.
Figure 5B:
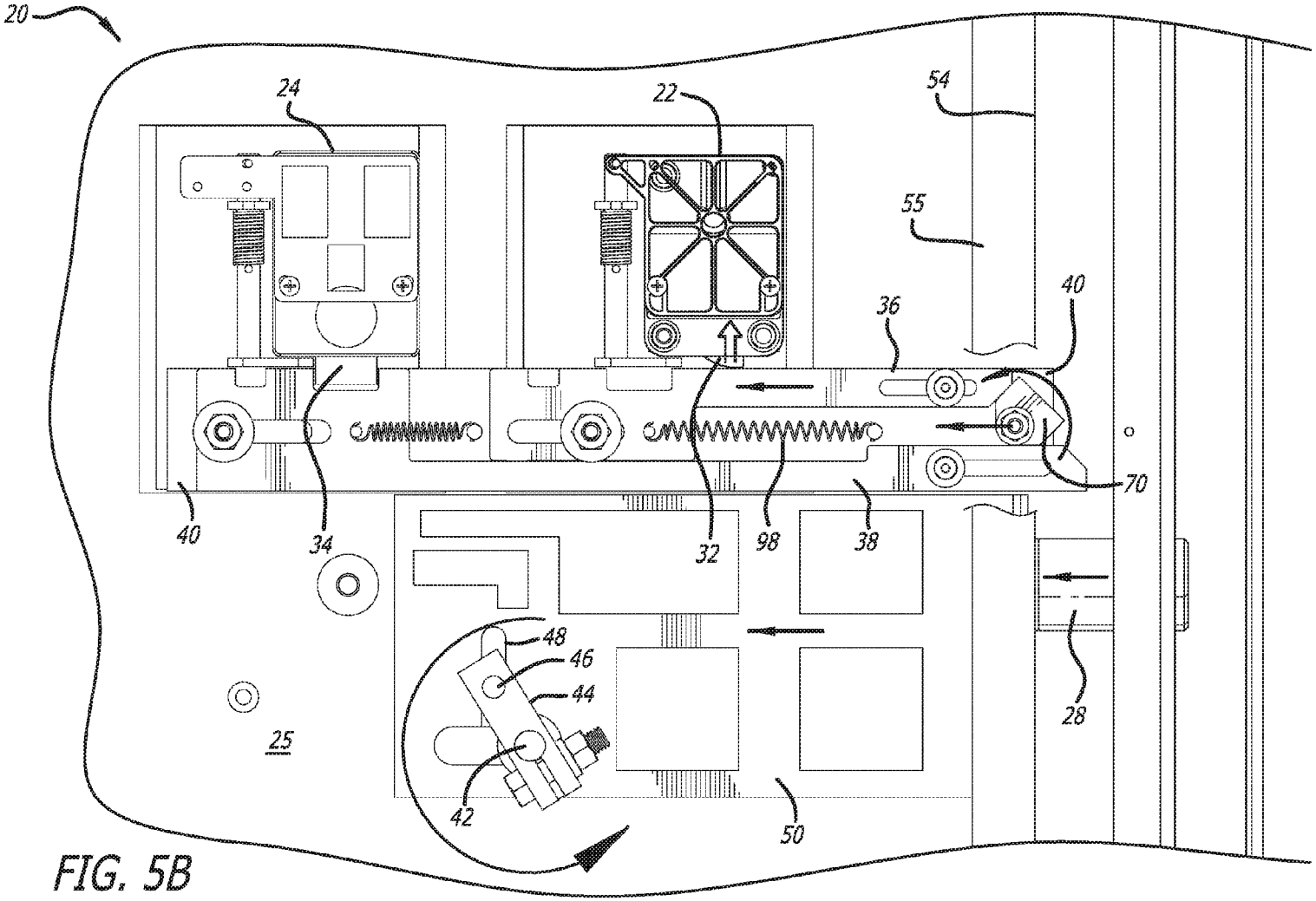
Figure 5C:
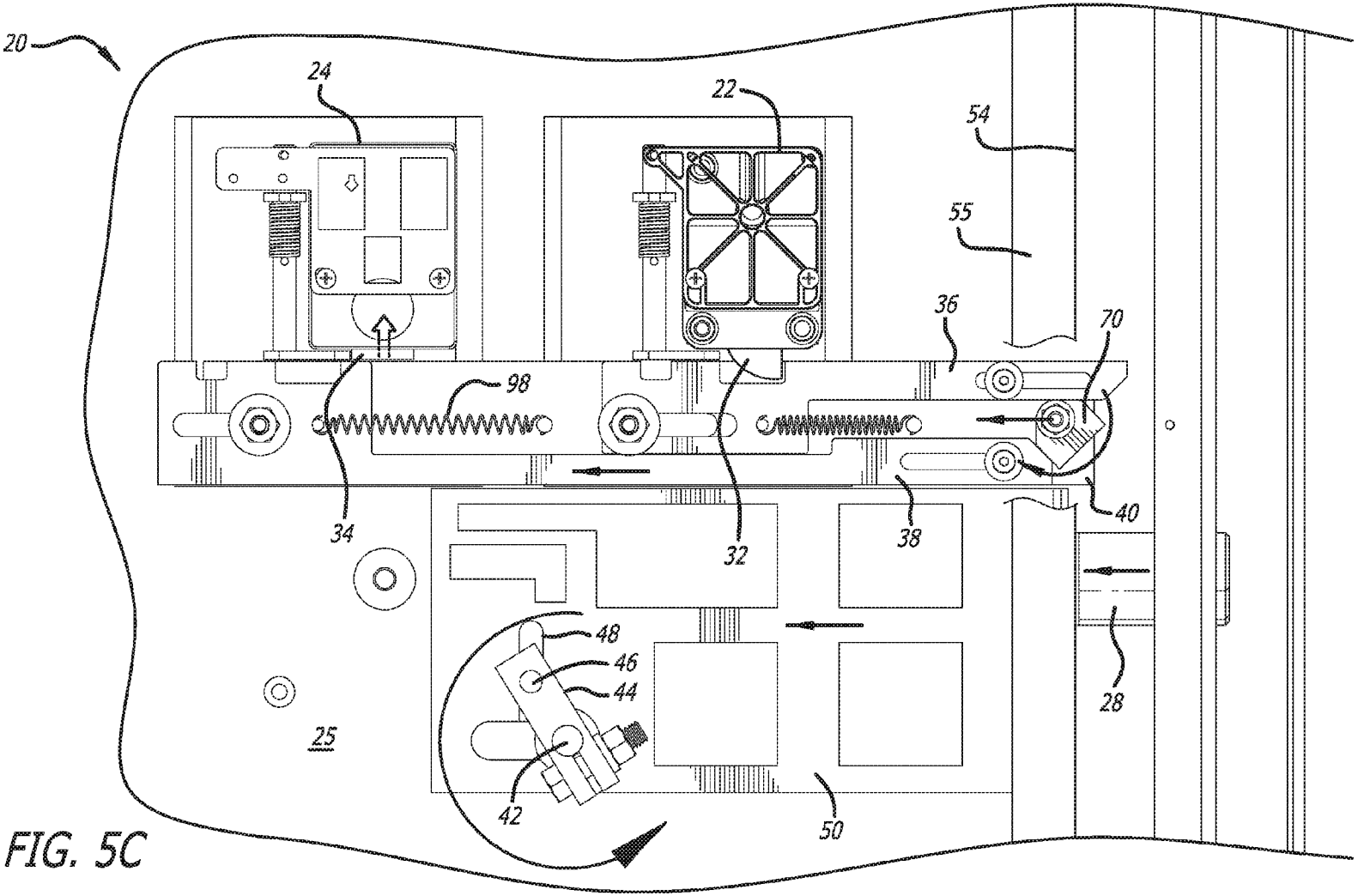

FIG. 5A-5C are perspective views of the interior locking/boltwork mechanism of the exemplary safe door showing the three main stages of operation. In FIG. 5A both of the latch bolts 32, 34 of the locks 22, 24 are extended into the cutouts in the two lock slides 36, 38. This is the locked configuration, in which the main locking bar 40, attached cam member 70 and the boltwork including the carriage bar 54 and locking bolts 28 are held to the right. Consequently, the drive plate 50 is held in place by its rigid connection to the carriage bar 54, and the handle 26 and handle shaft 42 are unable to turn by virtue of the interaction between the lever 44, pin 46 and slot 48. In this state, the locking bolts 28 extend into the adjacent door frame (not shown).

The cam member 70 has a pair of angled edges which abut against chamfered edges on the right end of each of the lock slides 36, 38, as seen. Because both of the lock slides 36, 38 are prevented from moving to the left by the latch bolts 32, 34 they also contact and prevent any rotational or leftward movement of the cam member 70.

In FIG. 5B, the e-lock 22 is open, and the boltwork has been retracted. More specifically, the latch bolt 32 retracts out of the cutout in the upper lock slide 36 which is then permitted to move to the left relative to the main locking bar 40, although nothing happens until the user rotates the handle 26 and handle shaft 42 (CCW when looking from the inside safe). Interaction between the lever 44, pin 46 and cam slot 48 thus instigates leftward movement of the drive plate 50. Because the drive plate 50 is securely attached to the carriage bar 54, it also moves to the left. Finally, because of the rigid connection between the carriage bar flange 55, main locking bar 40, and cam member 70, that assembly of components also moves to the left relative to the lower lock slide 38. Since the upper lock slide 36 can now slide against the bias of spring 98, the cam member 70 rotates CCW and an upper edge of the cam member 70 contacts the chamfered edge of the upper lock slide 36 to push the upper lock slide to the left.

During these movements, the lower lock slide 38 remains in place because of the extension of the latch bolt 34 into its cutout. Interaction between the lower angled edge of cam member 70 and the chamfered edge on the lower lock slide 38 causes the cam member to rotate in a CCW direction, as shown. Once the door is subsequently closed and the boltwork returned to its locked position as seen in FIG. 5A, the spring 98 shifts the upper lock slide 36 back to the right into its original position, thus permitting the latch bolt 32 to reengage the cutout therein.

In FIG. 5C, the mechanical (left) lock 24 is open, with the latch bolt 34 disengaged from the cutout in the lower lock slide 38, and the boltwork has been retracted. The e-lock 22 is shown closed, with the latch bolt 32 engaged with the cutout in the upper lock slide 36; though the e-lock could also be open.

In something of a mirror image of FIG. 5B, disengagement of the latch bolt 34 from the cutout in the lower lock slide 38 permits the lower lock slide to move. Once the handle 26 and its shaft 42 have been rotated (CCW again), the attached assembly of the drive plate 50, carriage bar 54 (and locking bolts 28), main locking bar 40 and cam member 70 slide to the left, as shown. The cam member 70 is shown rotated in a CW direction, since the upper lock slide 36 remains stationary while the lower lock slide 38 can slide to the left against the bias of spring 98. Once the door is subsequently closed and the boltwork returned to its locked position as seen in FIG. 5A, the spring 98 shifts the lower lock slide 38 back to the right into its original position, thus permitting the latch bolt 34 to reengage the cutout therein.

Dual locks are not a novelty in safe technology, but they have always been blocking a common "Locking Bar," such that both locks would require opening to articulate the boltwork. The redundant boltwork lock system presents a compound locking bar that alternates with either lock opening allowing boltwork retraction. Incidentally, both locks can also be opened in the redundant boltwork lock system, even though not necessary.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims.

It is claimed:

1. A redundant boltwork lock for a safe door configured to hingedly mount in a door frame, comprising:

a) a safe door having a hinge side and a locking side opposite thereto, the safe door further having an electronic lock and a mechanical lock mounted therein with controls exposed on a front face of the door, each of the electronic lock and mechanical lock including a locking mechanism on a rear face of the door having a lock bolt that is extended in a locked position and retracted in an open position;

b) a boltwork mounted to the rear face of the door and including a carriage bar having at least one locking bolt thereon, the carriage bar arranged for movement relative to the door such that the locking bolt extends laterally outward on the locking side for engagement with the door frame to lock the door relative to the frame;

c) a handle mounted to the front face of the door and having a rotating shaft that projects past the rear face of the door, the shaft being coupled to move a drive plate that is fixedly attached to the carriage bar and configured to move therewith so that rotation of the handle alternately displaces the carriage bar and locks and unlocks the door from the frame; and d) a sliding bar assembly including a main locking bar slidingly mounted to the rear face of the door and fixed with respect to the carriage bar, wherein extension of both of the lock bolts prevents movement of the main locking bar, carriage bar and attached lock bolts, drive plate and handle, while retraction of either of the lock bolts permits sliding movement of the main locking bar, such that rotation of the handle causes movement of the carriage bar, lock bolts, drive plate and unlocking of the door from the frame.

2. The apparatus of claim 1, wherein the sliding bar assembly also includes two lock slides secured to the main locking bar and configured to move relative thereto, each of the lock slides having a cutout into which extends an associated one of the lock bolts of the electronic lock or mechanical lock in their locked positions, wherein extension of both of the lock bolts into the cutouts of the associated lock slides prevents movement of the main locking bar, while retraction of either of the lock bolts from the cutout of the associated lock slide permits sliding movement of the main locking bar.

3. The apparatus of claim 2, wherein the sliding bar assembly also includes a rotating cam member fixed with respect to the carriage bar and with which one end each of both of the lock slides engages, wherein extension of both of the lock bolts prevents displacement of the lock slides and thus prevents rotation of the cam member, while retraction of either of the lock bolts from the cutout of the associated lock slide permits displacement of the associated lock slide and consequent rotation and displacement of the cam member.

4. The apparatus of claim 3, wherein both of the lock slides are biased toward the cam member.

5. The apparatus of claim 2, wherein each of the lock slides is biased toward a locked position that permits extension of the associated lock bolt into the lock slide cutout.

6. The apparatus of claim 5, wherein each of lock slides has a pair of sliding slots through which pass bolts that secure the lock slides to the main locking bar, and each lock slide is biased toward the locked position by a spring stretched between a stud fixed on the lock slide and a stud fixed on the main locking bar.

7. The apparatus of claim 6, wherein an upper one of the lock slides is shorter than a lower one of the lock slides, and the two lock slides have mating shapes, wherein the lower lock slide has an enlarged left end in which is formed one of the sliding slots and an elongated right end and the other sliding slot, and the upper lock slide has an enlarged left end in which is formed one of the sliding slots and an elongated right end and the other sliding slot.

8. The apparatus of claim 7, wherein the upper lock slide slides horizontally in a space created above the elongated right end of the lower lock slide, and has a vertical dimension such that a combined periphery of the lock slides closely matches a periphery of the main locking bar.

9. The apparatus of claim 1, wherein the handle shaft is journaled about an axis and a drive lever clamps over the handle shaft and rotates therewith, the drive lever carrying a cam pin on an end opposite the axis that extends into a cam slot formed in the drive plate, such that rotation of the handle shaft causes horizontal translation of the drive plate via the drive lever and cam pin/cam slot engagement.

10. The apparatus of claim 1, wherein the handle is a 5-spoke handle.

11. A redundant boltwork lock for a safe door configured to hingedly mount in a door frame, comprising:

a) a safe door having a hinge side and a locking side opposite thereto, the safe door further having an electronic lock and a mechanical lock mounted therein with controls exposed on a front face of the door, each of the electronic lock and mechanical lock including a locking mechanism on a rear face of the door having a lock bolt that is extended in a locked position and retracted in an open position;

b) a boltwork mounted to the rear face of the door and including a carriage bar having at least one locking bolt thereon, the carriage bar arranged for movement relative to the door such that the locking bolt extends laterally outward on the locking side for engagement with the door frame to lock the door relative to the frame;

c) a handle mounted to the front face of the door coupled to move a drive plate located on the rear face of the door that is fixedly attached to the carriage bar and configured to move therewith so that actuation of the handle displaces the carriage bar and alternately locks and unlocks the door from the frame; and d) a sliding bar assembly including two lock slides and a rotating cam member fixed with respect to the carriage bar, each of the lock slides having a cutout into which extends an associated one of the lock bolts of the electronic lock or mechanical lock in their locked positions, wherein extension of both of the lock bolts into the cutouts of the associated lock slides prevents rotation of the cam member and movement of the carriage bar and attached lock bolts, drive plate and handle, while retraction of either of the lock bolts from the cutout of the associated lock slide permits sliding movement of the associated lock slide and rotation and displacement of the cam member, such that actuation of the handle causes movement of the carriage bar, lock bolts, drive plate and unlocking of the door from the frame.

12. The apparatus of claim 11, wherein the sliding bar assembly also includes a main locking bar to which the two lock slides are secured and configured to move relative thereto, the cam member being secured to the main locking bar while being configured to rotate thereon and one end each of both of the lock slides engages the cam member, wherein extension of both of the lock bolts into the cutouts of the associated lock slides prevents movement of the two lock slides which in turn prevents rotation and displacement of the cam member and displacement of the main locking bar, and retraction of either of the lock bolts from the cutout of the associated lock slide permits rotation and displacement of the cam member and displacement of the main locking bar.

13. The apparatus of claim 12, wherein both of the lock slides are biased toward the cam member.

14. The apparatus of claim 11, wherein each of the lock slides is biased toward a locked position that permits extension of the associated lock bolt into the lock slide cutout.

15. The apparatus of claim 14, wherein the sliding bar assembly also includes a main locking bar to which the two lock slides are secured and configured to move relative thereto, and wherein each of lock slides has a pair of sliding slots through which pass bolts that secure the lock slides to the main locking bar, and each lock slide is biased toward the locked position by a spring stretched between a stud fixed on the lock slide and a stud fixed on the main locking bar.

16. The apparatus of claim 15, wherein an upper one of the lock slides is shorter than a lower one of the lock slides, and the two lock slides have mating shapes, wherein the lower lock slide has an enlarged left end in which is formed one of the sliding slots and an elongated right end and the other sliding slot, and the upper lock slide has an enlarged left end in which is formed one of the sliding slots and an elongated right end and the other sliding slot.

17. The apparatus of claim 16, wherein the upper lock slide slides horizontally in a space created above the elongated right end of the lower lock slide, and has a vertical dimension such that a combined periphery of the lock slides closely matches a periphery of the main locking bar.

18. The apparatus of claim 11, wherein the handle shaft is journaled about an axis and a drive lever clamps over the handle shaft and rotates therewith, the drive lever carrying a cam pin on an end opposite the axis that extends into a cam slot formed in the drive plate, such that rotation of the handle shaft causes horizontal translation of the drive plate via the drive lever and cam pin/cam slot engagement.

19. The apparatus of claim 11, wherein the handle is a 5-spoke handle.

* * * * *